US010343887B2

(12) United States Patent
Bhutani et al.

(10) Patent No.: US 10,343,887 B2
(45) Date of Patent: Jul. 9, 2019

(54) LOW-PRESSURE CARBONATION FOR CARBONATED SOFT DRINK EQUIPMENT

(71) Applicant: PepsiCo, Inc., Purchase, NY (US)

(72) Inventors: Gurmeet Singh Bhutani, Gurgaon (IN); Rahul Sadashiv Kamble, Faridabad (IN); Amandeep Singh Gulati, New Delhi (IN)

(73) Assignee: PepsiCo, Inc., Purchase, NY (US)

( * ) Notice: Subject to any disclaimer, the term of this patent is extended or adjusted under 35 U.S.C. 154(b) by 0 days.

(21) Appl. No.: 15/687,995

(22) Filed: Aug. 28, 2017

(65) Prior Publication Data

US 2018/0057343 A1 Mar. 1, 2018

(30) Foreign Application Priority Data

Aug. 30, 2016 (IN) ..... 201641029458

(51) Int. Cl.
*B67D 1/12* (2006.01)
*B67C 3/12* (2006.01)
*B67D 1/00* (2006.01)

(52) U.S. Cl.
CPC ..... *B67D 1/1243* (2013.01); *B67C 3/12* (2013.01); *B67D 1/0009* (2013.01); *B67D 1/0036* (2013.01); *B67D 1/0044* (2013.01); *B67D 1/0051* (2013.01); *B67D 1/0071* (2013.01); *B67D 1/1252* (2013.01); *B67D 2210/00104* (2013.01); *B67D 2210/00157* (2013.01)

(58) Field of Classification Search
CPC ..... B67D 1/1243
See application file for complete search history.

(56) References Cited

U.S. PATENT DOCUMENTS 2,339,640 A 1/1944 Holinger
4,940,164 A * 7/1990 Hancock ..... B01F 3/04241 222/146.6
6,234,349 B1 5/2001 Bilskie et al.
2002/0113087 A1* 8/2002 Ziesel ..... B67D 1/0007 222/129.1

(Continued)

FOREIGN PATENT DOCUMENTS

GB 2 157 963 A 11/1985

OTHER PUBLICATIONS

International Search Report and Written Opinion of the International Searching Authority for International Application No. PCT/US2017/048838, dated Nov. 20, 2017 (14 pages).

*Primary Examiner* — J C Jacyna
(74) *Attorney, Agent, or Firm* — Sterne, Kessler, Goldstein & Fox P.L.L.C.

(57) ABSTRACT

A carbonated drink dispensing system includes a carbonation tank, a $CO_2$ cylinder configured to deliver $CO_2$ to the carbonation tank at a pressure of between 50 psi and 60 psi, a low-pressure pump configured to pump water into the carbonation tank, and a level sensor configured to determine when the water in the carbonation tank has reached a pre-determined level. The low-pressure pump is configured to stop pumping water when the level sensor determines that the water in the carbonation tank has reached the pre-determined level. The low-pressure pump starts pumping water again after a time delay.

18 Claims, 8 Drawing Sheets

(56) References Cited

U.S. PATENT DOCUMENTS

| | | | | |
|---|---|---|---|---|
| 2003/0071060 | A1* | 4/2003 | Haskayne | B67D 1/0057 222/129.1 |
| 2003/0159447 | A1* | 8/2003 | Sergio | B67D 1/07 62/3.64 |
| 2004/0112917 | A1* | 6/2004 | Groesbeck | B67D 1/0021 222/105 |
| 2008/0083235 | A1 | 4/2008 | Wang | |
| 2014/0374438 | A1 | 12/2014 | Carpenter et al. | |
| 2015/0201790 | A1* | 7/2015 | Smith | A23F 3/18 426/431 |
| 2015/0291409 | A1* | 10/2015 | Crisp, III | B67D 1/0057 222/23 |
| 2016/0106136 | A1* | 4/2016 | Gordon | A47J 31/407 426/477 |

* cited by examiner

LOW-PRESSURE CARBONATION FOR CARBONATED SOFT DRINK EQUIPMENT

CROSS-REFERENCE TO RELATED APPLICATIONS

This application claims priority to Indian Application No. 201641029458, filed Aug. 30, 2016, which is incorporated herein in its entirety by reference thereto.

BACKGROUND

Field

Embodiments of the present invention relate generally to carbonation systems for carbonated soft drink equipment, and more specifically to low-pressure carbonation systems for carbonated soft drink equipment.

Background

Carbonated soft drink equipment may produce soft drinks using a carbonation tank. For example, $CO_2$ gas and water may be mixed in the carbonation tank to make soda. Current carbonation systems use high-pressure carbonation to meet gas volume specifications for soda strength.

BRIEF SUMMARY OF THE INVENTION

In some embodiments, a carbonated drink dispensing system includes a carbonation tank, a $CO_2$ cylinder configured to deliver $CO_2$ to the carbonation tank at a pressure of between 50 pounds per square inch ("PSI") and 60 PSI, a low-pressure pump configured to pump water into the carbonation tank, and a level sensor configured to determine when the water in the carbonation tank has reached a pre-determined level. In some embodiments, the low-pressure pump is configured to stop pumping water when the level sensor determines that the water in the carbonation tank has reached the pre-determined level. In some embodiments, the low-pressure pump starts pumping water after a time delay.

In some embodiments, the low-pressure pump comprises a diaphragm pump. In some embodiments, the low-pressure pump comprises a positive displacement pump. In some embodiments, the low-pressure pump comprises a self-priming pump.

In some embodiments, the low-pressure pump operates at a pressure of between 60 PSI and 120 PSI. In some embodiments, a highest pressure in the carbonated drink dispensing system is 125 PSI.

In some embodiments, the carbonated drink dispensing system also includes a controller. In some embodiments, the controller is configured to stop the low-pressure pump based on the level sensor determining that the water in the carbonation has reached the pre-determined level. In some embodiments, the controller is configured to determine the time delay based on a desired concentration of $CO_2$ to water.

In some embodiments, the predetermined level comprises a high level. In some embodiments, the time delay is between 0.5 and 6 seconds. In some embodiments, the time delay can be programmed in the controller. In some embodiments, the level sensor is configured to determine when the water is no longer at the pre-determined level.

In some embodiments, the time delay begins upon dispensing of a carbonated drink from the carbonated drink dispensing system. In some embodiments, the level sensor comprises a capacitance level sensor. In some embodiments, the level sensor comprises an infrared emitter and an infrared receiver.

In some embodiments, a carbonated drink dispensing system includes a carbonation tank, a low-pressure pump configured to pump water into the carbonation tank, a beverage post mix valve and mixing nozzle operatively connected to the carbonation tank, a plurality of gas pumps configured to pump beverage concentrate to the beverage dispenser, a $CO_2$ cylinder, and a pressure regulator configured to deliver $CO_2$ from the $CO_2$ cylinder to the carbonation tank at a first pressure and from the $CO_2$ cylinder to the plurality of gas pumps at the first pressure.

In some embodiments, the carbonated drink dispensing system also includes tubing between the pressure regulator and the carbonation tank. In some embodiments, the tubing comprises polyethylene. In some embodiments, the carbonated drink dispensing system also includes quick connectors configured to connect sections of the tubing. In some embodiments, the quick connectors comprise plastic.

In some embodiments, the first pressure is less than 60 PSI. In some embodiments, the first pressure is 55 PSI.

Further features and advantages of embodiments of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to a person skilled in the relevant art(s) based on the teachings contained herein.

BRIEF DESCRIPTION OF THE DRAWINGS/FIGURES

The accompanying drawings, which are incorporated herein and form part of the specification, illustrate embodiments of the present invention and, together with the description, further serve to explain the principles of the invention and to enable a person skilled in the relevant art(s) to make and use the invention.

Features and advantages of the embodiments will become more apparent from the detailed description set forth below when taken in conjunction with the drawings, in which like reference characters identify corresponding elements throughout.

DETAILED DESCRIPTION OF THE INVENTION

Figure 1:
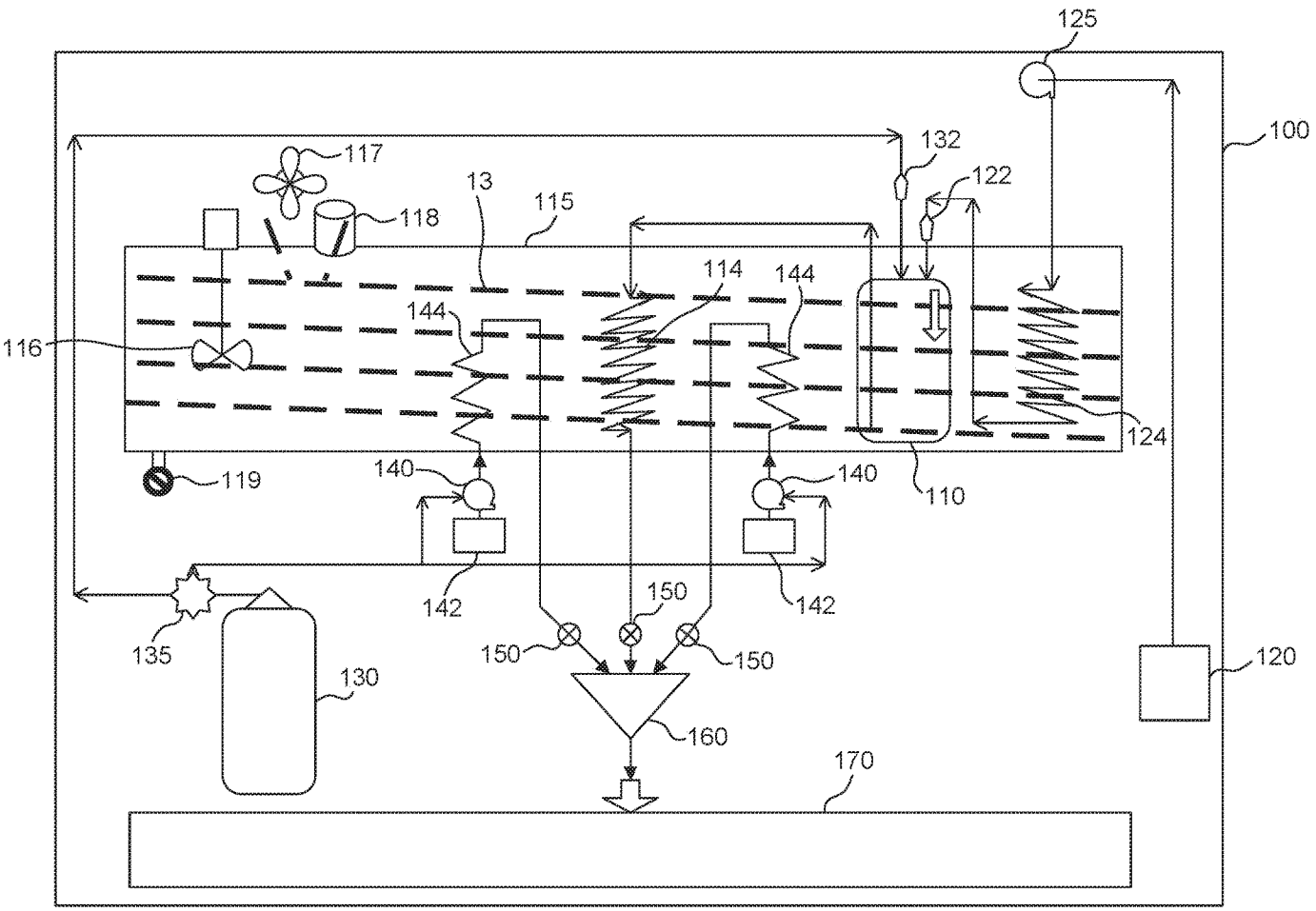
FIG. 1 shows a schematic view of a low-pressure carbonation system according to some embodiments.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Carbonated soft drink equipment, such as beverage dispensers (also known as fountain systems), may produce soft drinks using a carbonation tank. For example, $CO_2$ gas and water may be mixed in the carbonation tank to make soda and carbonated soft drinks. Current carbonation systems use high-pressure carbonation to meet gas volume specifications for soda strength. A higher pressure of $CO_2$ gas may contribute to a higher volume of gas in the carbonated beverage.

For example, the gas pressure in current systems is typically between 80 and 90 pounds per square inch ("PSI"). In other words, the $CO_2$ gas inside the carbonation tank may be maintained at 80 to 90 PSI. To add water into the carbonation tank, which is filled with $CO_2$ gas at 80 to 90 PSI, the water pressure must be greater than 90 PSI. For example, the water pump pressure is typically between 90 and 140 PSI, with a water flow rate of more than 6 liters per minute. Moreover, as the carbonation tank is filled, the pressure inside the tank continues to increase and the flow rate drops drastically. Accordingly, the pump has to do extra work to fill the tank and the system pressure may rise to 150 to 180 PSI.

While high-pressure carbonation may meet gas volume specifications, high-pressure carbonation requires heavier components (e.g., tubing, connectors, etc.) for safe operation of the carbonated soft drink equipment at the high operating pressure, which leads to higher costs for the system. For example, while the system pressure reaches up to 180 PSI, components of the beverage dispensing system need to be designed for an even higher pressure to make the system safe, often with a safety factor of up to 5. These safety design considerations increase the cost of the equipment.

In addition, high-pressure carbonation requires a high-pressure pump to accommodate the high operating pressure. For example, a high capacity (i.e., high flow and high pressure) vane pump may be used. Such high capacity pumps are heavy, expensive, and unreliable in dry run. High capacity pumps will often require a pressure boosting system to increase the pressure of the water from a water source prior to entering the high capacity pump. High capacity pumps often account for service calls in current carbonated soft drink equipment systems, such as beverage dispensers.

Finally, $CO_2$ gas from a $CO_2$ cylinder (i.e., a gas storage tank) is used to carbonate water and to operate gas pumps for dispensing syrup. As already mentioned, $CO_2$ gas is supplied to the carbonation tank to carbonate water at a pressure of 80-95 PSI. And the gas pumps for dispensing syrup operate at a pressure of 50-60 PSI. Thus, the pressure of the $CO_2$ gas from the storage tank is regulated at two different pressures: 50-60 PSI for operating the syrup gas pumps; and 80-95 PSI for carbonating water. Regulating the $CO_2$ gas at these two different pressures adds further cost to the system.

Accordingly, in some embodiments, a low-pressure carbonation system (i.e., a system that operates at a lower pressure than described above) may be used in carbonated soft drink equipment to make the equipment safer to use and more cost-effective, while still meeting gas volume specifications for soda strength. For example, a low-pressure carbonation system may include a $CO_2$ source, such as a $CO_2$ cylinder. In some embodiments, the low-pressure carbonation system may include a carbonation tank, where water and $CO_2$ gas mix to create a carbonated beverage. In some embodiments, the low-pressure carbonation system may include a plurality of gas pumps configured to dispense a variety of syrup flavors. The gas pumps may be operated by $CO_2$ gas from the $CO_2$ cylinder. In some embodiments, a single regulator is coupled to the $CO_2$ cylinder to regulate the pressure of the $CO_2$ gas that is delivered to the carbonation tank and the pressure of the $CO_2$ gas that is delivered to the gas pumps for syrup dispensing. For example, the regulator may keep the pressure of $CO_2$ gas at 55 PSI for delivery to the carbonation tank and the gas pumps.

In some embodiments, the low-pressure carbonation system may include a low-pressure pump, such as a positive displacement pump (e.g., a diaphragm pump) to pump water into the carbonation tank. In some embodiments, the low-pressure pump may be a self-priming pump. In some embodiments, the low-pressure pump may operate at a pressure of 60-120 PSI.

In some embodiments, the low-pressure pump is configured to shut off when the water in the carbonation tank reaches a pre-determined level. In some embodiments, the low-pressure pump is configured to turn on after a time delay from an event, such as dispensing of a carbonated beverage from the carbonated soft drink equipment. For example, when water in the carbonation tank falls below the pre-determined level, the time delay may begin. In some embodiments, the time delay is between 0.5-6 seconds (e.g., 4 or 5 seconds). The time delay allows for the water to enter the carbonation tank at the appropriate time so that gas volume specifications for soda strength are met. For example, if the water enters the carbonation tank while the carbonated soft drink equipment is dispensing, the water will not have enough time to mix with $CO_2$ to reach gas volume specifications for soda strength.

In some embodiments, a controller is configured to control the operation of the low-pressure pump, the carbonation tank, and other components of the carbonated soft drink equipment. In some embodiments, the operating pressure of the low-pressure carbonation system, the flow rate of water through low-pressure pump, and the time delay contribute to achieving gas volume specifications for soda strength.

These and other embodiments are discussed below with reference to the figures. However, those skilled in the art will readily appreciate that the detailed description given herein with respect to these figures is for explanatory purposes only and should not be construed as limiting.

A low-pressure carbonation system 100, as shown, for example, in FIG. 1, may be utilized in carbonated soft drink equipment. In some embodiments, low-pressure carbonation system 100 may include a carbonation tank 110. In some embodiments, carbonation tank 110 is configured to receive gas (e.g., $CO_2$) and water. For example, water from a water source 120 may be pumped into carbonation tank 110. In some embodiments, water from water source 120 is pumped into carbonation tank 110 via a low-pressure pump 125. In some embodiments, gas from a gas source 130 is supplied to carbonation tank 110. In some embodiments, the gas and water mix in carbonation tank 110 to form a soda or carbonated soft drink.

In some embodiments, carbonation tank 110 is disposed in an ice bath 115. In some embodiments, ice bath 115 comprises between 40% and 60% ice. Ice bath 115 may be maintained at a temperature of 0° Celsius. In some embodiments, ice bath 115 provides a system for cooling beverage components, such as water, carbonated water, and/or syrup. For example, low-pressure carbonation system 100 may include carbonated water cooling coils 114, water cooling coils 124, and syrup cooling coils 144. In some embodiments, each of carbonated water cooling coils 114, water cooling coils 124, and syrup cooling coils 144 may be disposed in ice bath 115. In some embodiments, each of carbonated water cooling coils 114, water cooling coils 124, and syrup cooling coils 144 provide an elongated path for the respective beverage component, thus allowing more time for heat exchange between the beverage component and ice bath 115.

In some embodiments, water cooling coils 124 help water from low-pressure pump 125 reach an optimal temperature for mixing with $CO_2$ gas in carbonation tank 110. In addition, the lower flow rate of low-pressure pump 125 also causes water to be within water cooling coils 124 for a longer period of time, further contributing to water from low-pressure pump 125 reaching an optimal temperature for mixing with $CO_2$ gas in carbonation tank 110.

In some embodiments, ice bath 115 is kept at a cold temperature through use of a refrigeration system. In some embodiments, low-pressure carbonation system 100 may include components for a refrigeration system, such as a condenser fan 117, a compressor 118, and an evaporator coil 13. In some embodiments, ice bath 115 may include an agitator 116. In some embodiments, agitator 116 may keep the temperature of ice bath 115 uniform and may increase the amount of heat transfer from carbonated water cooling coils 114, water cooling coils 124, and syrup cooling coils 144. In some embodiments, ice bath 115 includes an ice bath drain 119, which may facilitate emptying water and ice from ice bath 115 for cleaning or servicing of components.

As noted above, water from water source 120 may be pumped into carbonation tank 110. In some embodiments, water source 120 comprises a source of running water, such as a water supply line of a building. In some embodiments, water source 120 comprises a water container, such as a tank, jug, jar, pitcher, etc. In some embodiments, water source 120 holds up to 5 gallons of water.

In some embodiments, low-pressure pump 125 comprises a self-priming pump. A self-priming pump may operate without a pressure booster system. Thus, low-pressure pump 125 may be connected to running water with a minimum pressure of 0 PSI (against gravity) as water source 120 and effectively pump water into carbonation tank 110 without a pressure booster system. In addition, low-pressure pump 125 may pump water from a water container, such as a 5 gallon jug, without a pressure booster system. Thus, in some embodiments, low-pressure carbonation system 100 does not include a pressure booster system or pressure booster pump.

In some embodiments, low-pressure pump 125 comprises a positive displacement pump. In some embodiments, low-pressure pump 125 comprises a diaphragm pump. Other similar pumps may also be used. In some embodiments, low-pressure pump 125 operates at a pressure from 60 to 120 PSI. In some embodiments, low-pressure pump 125 pumps water from water source 120 through water cooling coils 124 into carbonation tank 110. In some embodiments, the flow rate of low-pressure pump 125 is up to 1 liter per minute. In some embodiments, a valve 122 is disposed along the tubing between low-pressure pump 125 and carbonation tank 110. In some embodiments, valve 122 comprises a check valve.

For low-pressure pump 125 to effectively operate at this lower pressure (compared to pressures from 90 to 140 PSI in conventional systems), the $CO_2$ gas in carbonation tank 110 may also be at a lower pressure. In some embodiments, $CO_2$ gas is supplied to carbonation tank 110 at a pressure of less than 70 PSI. In some embodiments, $CO_2$ gas is supplied to carbonation tank 110 at a pressure of less than 60 PSI. In some embodiments, $CO_2$ gas is supplied to carbonation tank 110 at a pressure of about 55 PSI.

In some embodiments, gas is supplied to carbonation tank 110 from gas source 130. For example, gas source 130 may be a gas tank or cylinder, as shown in FIG. 1. In some embodiments, gas source 130 comprises a source of $CO_2$ gas. In some embodiments, a regulator 135 is attached to gas source 130. Regulator 135 may maintain the pressure of the gas from gas source 130. In some embodiments, regulator 135 maintains the gas at a pressure of 55 PSI. In some embodiments, regulator 135 is configured to deliver gas at a first pressure (e.g., 55 PSI) to carbonation tank 110. In some embodiments, gas is delivered to carbonation tank 110 through a valve 132. In some embodiments, valve 132 comprises a check valve.

In some embodiments, regulator 135 is configured to deliver gas at the first pressure to one or more gas pumps 140 in low-pressure carbonation system 100. In some embodiments, gas pumps 140 are configured to pump a beverage component, such as syrup, to mix with carbonated water. In some embodiments, the syrup may mix with carbonated water before being dispensed from the carbonated soft drink equipment. In some embodiments, the syrup may mix with carbonated water as the beverage is being dispensed from the carbonated soft drink equipment. For example, gas pump 140 may pump syrup from a syrup source 142 through syrup cooling coils 144 within ice bath 115 and through a valve 150 into a nozzle 160. In some embodiments, syrup source 142 comprises a bag-in-box container.

In some embodiments, low-pressure carbonation system 100 includes a plurality of valves 150. For example, low-pressure carbonation system 100 may include one valve 150 for each syrup source 142 and one valve 150 for carbonated water from carbonation tank 110. In some embodiments, carbonated water from carbonation tank 110 is supplied through carbonated water cooling coils 114 within ice bath 115 and through valve 150 into nozzle 160.

In some embodiments, syrup and carbonated water may mix within nozzle 160. In some embodiments, multiple gas pumps 140, syrup sources 142, and valves 150 are used in low-pressure carbonation system 100. In some embodiments, syrup and carbonated water mix within nozzle 160 to create a beverage. In some embodiments, the beverage is dispensed from the carbonated soft drink equipment into dispensing area 170. In some embodiments, modular valves 150 with a single nozzle 160 may be used to dispense a drink, as described above. In some embodiments, instead of nozzle 160, other types of beverage dispensers may be used. For example, in some embodiments, discrete post mix valves may be used to dispense a beverage directly into a cup instead of using a single nozzle (e.g., nozzle 160).

In some embodiments, because carbonation tank 110 and gas pumps 140 operate at the same gas pressure (e.g., 55 PSI), only a single regulator 135 is utilized in low-pressure carbonation system 100. For example, regulator 135 may provide gas both to carbonation tank 110 and gas pumps 140 at the first pressure. In some embodiments, the first pressure is 55 PSI.

Figure 2:
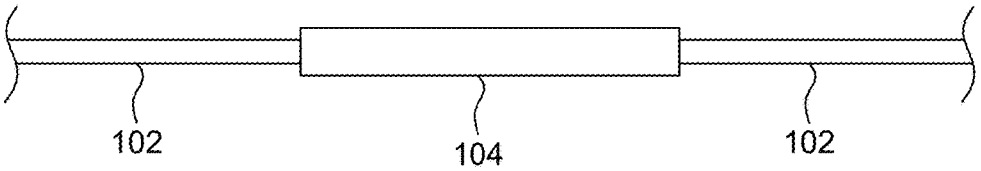
FIG. 2 shows tubing of a low-pressure carbonation system according to some embodiments.

With the carbonation tank 110 receiving gas at a pressure of 55 PSI and low-pressure pump 125 operating between 60 and 120 PSI, in some embodiments, a maximum pressure of low-pressure carbonation system 100 may be 125 PSI. This may allow for different materials to be used in components of low-pressure carbonation system 100 while still maintaining safety. In some embodiments, as shown, for example, in FIG. 2, the tubing 102 of low-pressure carbonation system 100 (e.g., tubing 102 between gas source 130, regulator 135, and carbonation tank 110, carbonated water cooling coils 114, water cooling coils 124, syrup cooling coils 144, and other tubing between low-pressure pump 125 and carbonation tank 110) may comprise polyethylene tubes 102.

In some embodiments, tubing 102 of low-pressure carbonation system 100 may be connected to each other via quick connectors 104. In some embodiments, tubing 102 of low-pressure carbonation system 100 may be connected to other components of low-pressure carbonation system 100 via quick connectors 104. In some embodiments, quick connectors 104 may be plastic.

Figure 3:
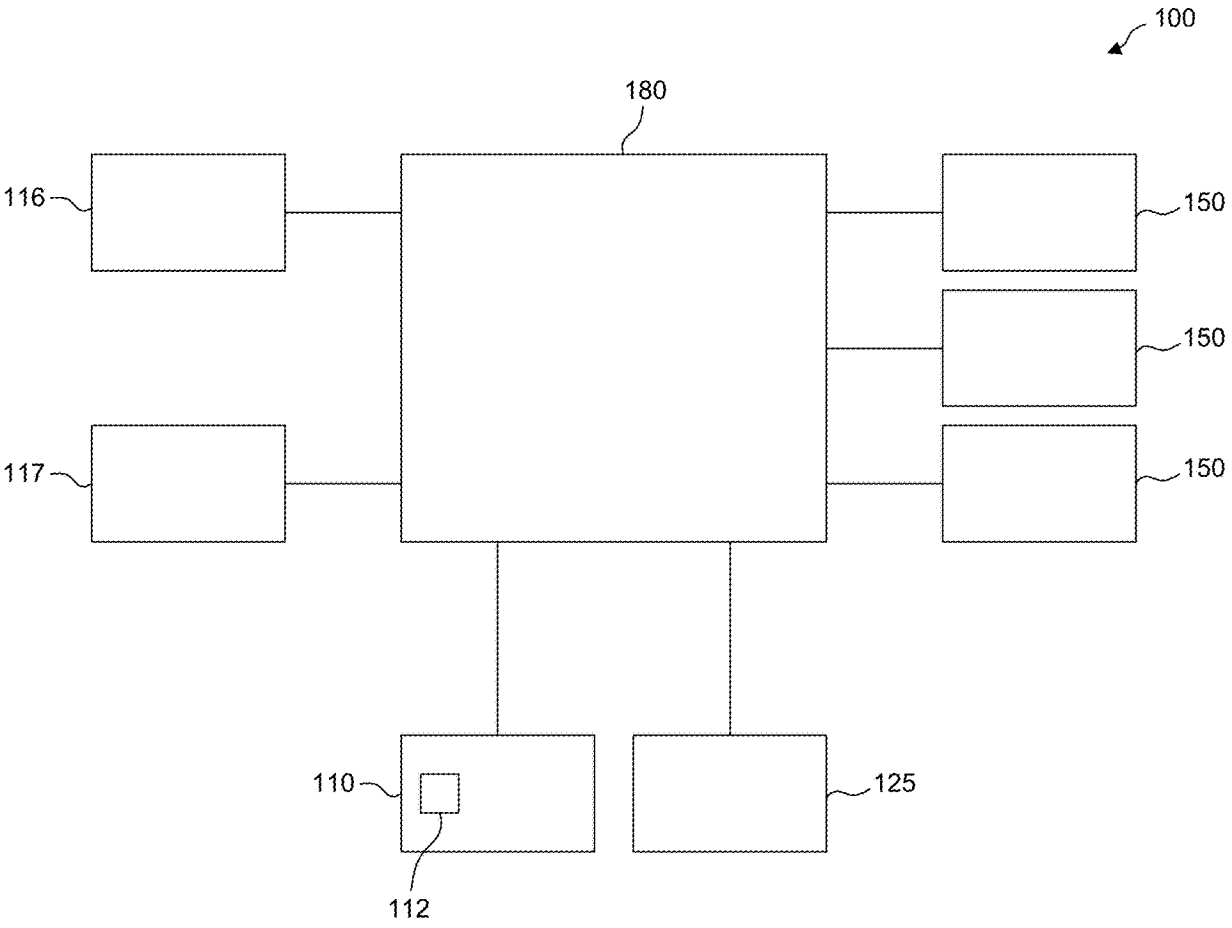
FIG. 3 shows a schematic view of the control of a low-pressure carbonation system according to some embodiments.

In some embodiments, as shown, for example, in FIG. 3, low-pressure carbonation system 100 includes an electronic controller 180. In some embodiments, controller 180 is a smart controller. In some embodiments, controller 180 is configured to control the operation of low-pressure carbonation system 100. For example, controller 180 may be connected to various components of low-pressure carbonation system 100. In some embodiments, controller 180 may be connected to agitator 116. Thus, controller 180 may communicate with agitator 116 to activate agitator 116 when needed (e.g., when ice bath 115 needs to be stirred) and to deactivate agitator 116. In some embodiments, controller 180 may be connected to components of the refrigeration system, such as condenser fan 117. For example, controller 180 may activate or deactivate condenser fan 117 to ensure ice bath 115 reaches appropriate temperatures.

In some embodiments, controller 180 may control the opening and closing of valves 150. For example, an input from a user, such as the press of a button or lever, may be received at controller 180. Controller 180 may then communicate with valves 150 to open the appropriate valves 150 based on the input from the user.

In some embodiments, controller 180 may be connected to components of carbonation tank 110 and low-pressure pump 125. In some embodiments, controller 180 may receive signals from carbonation tank 110 regarding a state of carbonation tank 110. For example, a level sensor 112 of carbonation tank 110 may send signals to controller 180. In some embodiments, controller 180 may activate or deactivate low-pressure pump 125 based, at least in part, on the signals received from carbonation tank 110. For example, when carbonation tank 110 is filled with water, controller 180 may receive a signal that carbonation tank 110 is full. In turn, controller 180 may send a signal to low-pressure pump 125 to stop pumping water from water source 120. In some embodiments, controller 180 may receive a signal that carbonation tank 110 is empty. In turn, controller 180 may send a signal to low-pressure pump 125 to begin pumping water from water source 120.

In some embodiments, controller 180 comprises a printed circuit board. In some embodiments, the printed circuit board may be programmable. For example, a time delay may be programmed into the printed circuit board of controller 180. Other features may be programmed into the printed circuit board of controller 180, such as, for example, a flow rate of low-pressure pump 125 or of dispensing from low-pressure carbonation system 100 (i.e., from a beverage dispenser such as nozzle 160). In some embodiments, the flow rate from nozzle 160 (or from a discrete valve or other beverage dispenser) is no more than 3 ounces per second. In some embodiments, the flow rate from nozzle 160 is between 1.5 to 2.5 ounces per second. This flow rate may contribute to achieving gas volume specifications.

In addition, instructions for the operation of various components of low-pressure carbonation system 100 may be programmed. For example, the printed circuit board of controller 180 may be programmed to shut off low-pressure pump 125 if low-pressure pump 125 is running dry. As another example, the printed circuit board of controller 180 may be programmed to shut off agitator 116, for example, if the current is too high or the motor of agitator 116 is too hot, and turning on agitator 116 when the motor is at an appropriate temperature. This may contribute to better ice bank formation by reducing the heat added to ice bath 115 from the motor of agitator 116 and allowing for quicker and more uniform ice formation. It may also increase the life of the motor of agitator 116.

In some embodiments, the printed circuit board of controller 180 may be programmed to allow only one valve 150 to operate at a time. In some embodiments, due to the low operating pressure of low-pressure carbonation system 100, allowing only one valve 150 to operate at a time assists in producing more drinks in a shorter amount of time.

Figure 4:
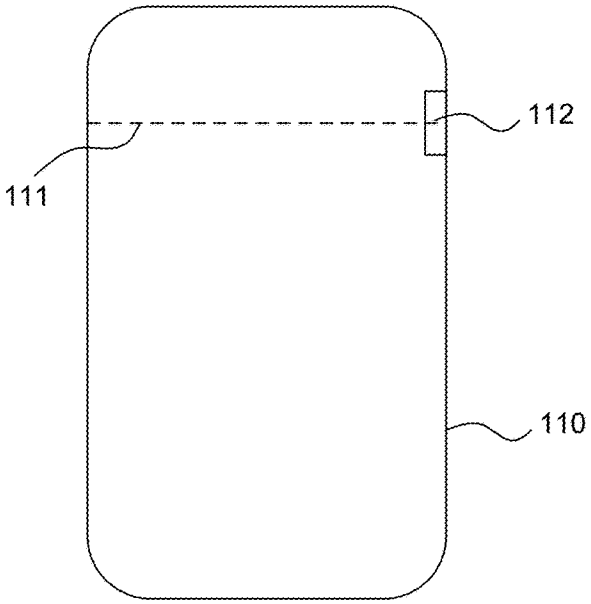
FIG. 4 shows a carbonation tank for a low-pressure carbonation system according to some embodiments.

In some embodiments, carbonation tank 110 includes one or more sensors to determine when carbonation tank 110 is full and/or empty. In some embodiments, as shown, for example, in FIG. 4, carbonation tank 110 includes a high level sensor 112. In some embodiments, high level sensor 112 is configured to determine when the water in carbonation tank 110 has reached a level 111, indicating that carbonation tank 110 is full. In some embodiments, high level sensor 112 is operatively connected to controller 180. High level sensor 112 may communicate to controller 180 when the water in carbonation tank 110 has reached level 111.

Figure 5:
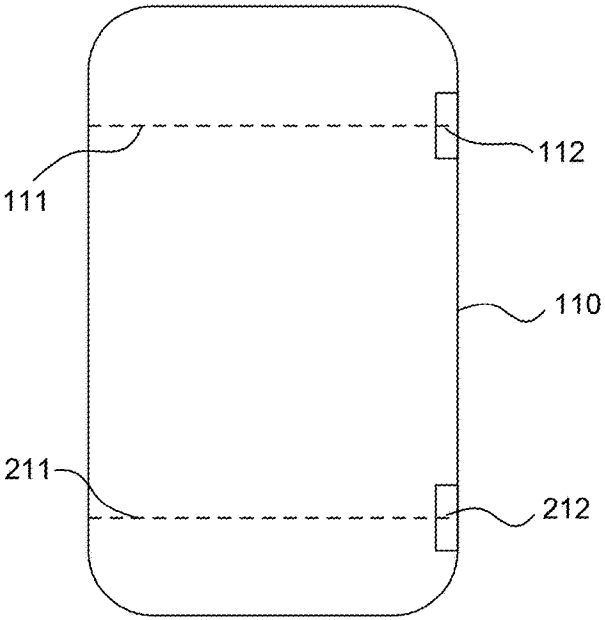
FIG. 5 shows a carbonation tank for a low-pressure carbonation system according to some embodiments.

In some embodiments, high level sensor 112 is the only sensor included in carbonation tank 110. In some embodiments, high level sensor 112 may determine when controller 180 will deactivate low-pressure pump 125. For example, as explained above, controller 180 may receive a signal from high level sensor 112 that carbonation tank 110 is filled with water, and controller 180 may then send a signal to low-pressure pump 125 to stop pumping. In some embodiments, instead of relying on a sensor, such as a low level sensor 212 (see FIG. 5), to activate low-pressure pump 125, controller 180 may be configured to activate low-pressure pump 125 based on a time delay. This may further reduce the cost of low-pressure carbonation system 100 because it eliminates a sensor. In addition, relying on a time delay may assist low-pressure carbonation system 100 in reaching gas volume specifications for soda strength.

In some embodiments, the time delay begins upon an event. In some embodiments, the time delay may begin upon dispensing of a carbonated drink from low-pressure carbonation system 100. In some embodiments, controller 180 receives a signal from valve 150 that a beverage has been dispensed. In some embodiments, controller 180 receives a signal from high level sensor 112 that a beverage has been dispensed. For example, high level sensor 112 may detect when the water has dropped below level 111 and send a signal to controller 180 accordingly. Upon receiving such a signal (e.g., from valve 150 and/or high level sensor 112), controller 180 may begin the time delay. After the time of the time delay has elapsed, controller 180 may send a signal to low-pressure pump 125 to begin pumping water from water source 120 to fill carbonation tank 110.

In some embodiments, the time delay may be up to 6 seconds. In some embodiments, the time delay is between 0.5 and 6 seconds. In some embodiments, the time delay can be programmed into controller 180. Other time delays may be used based on the needs of low-pressure carbonation system 100. For example, the time delay may depend on the amount of carbonated water dispensed from low-pressure carbonation system 100, the time it takes to dispense a certain amount of carbonated water, or the time to refill carbonation tank 110 to high level 111.

In some embodiments, the time delay is determined by controller 180. In some embodiments, controller 180 determines the time delay based on gas volume specifications for soda strength (i.e., desired carbonation level). In some embodiments, the longer the time delay, the stronger the soda strength (higher carbonation level). For example, more time passing may allow water to enter or refill carbonation tank 110 at the right time so that there is enough time for water to mix with $CO_2$. In some embodiments, the time delay is long enough so that low-pressure pump 125 is not pumping while low-pressure carbonation system 100 is dispensing. In some embodiments, low-pressure carbonation system 100 is configured to not allow dispensing while low-pressure pump 125 is pumping. In some embodiments, the combination of the time delay, the low pressure of low-pressure carbonation system 100, and the flow rate from low-pressure pump 125 allow for the carbonated drink to achieve gas volume specifications for soda strength.

In some embodiments, carbonation tank 110 may include an additional sensor, such as low level sensor 212. In some embodiments, low level sensor 212 is configured to determine when the water in carbonation tank 110 has reached a level 211, indicating that carbonation tank 110 is empty. In some embodiments, low level sensor 212 is operatively connected to controller 180. Low level sensor 212 may communicate to controller 180 when the water in carbonation tank 110 has reached level 211. In some embodiments, as shown, for example, in FIG. 5, carbonation tank 110 may include both high level sensor 112 and low level sensor 212.

In some embodiments, when controller 180 receives communication from high level sensor 112 or low level sensor 212, controller 180 may cause low-pressure pump 125 to activate or deactivate, respectively, as explained above.

Figure 6:
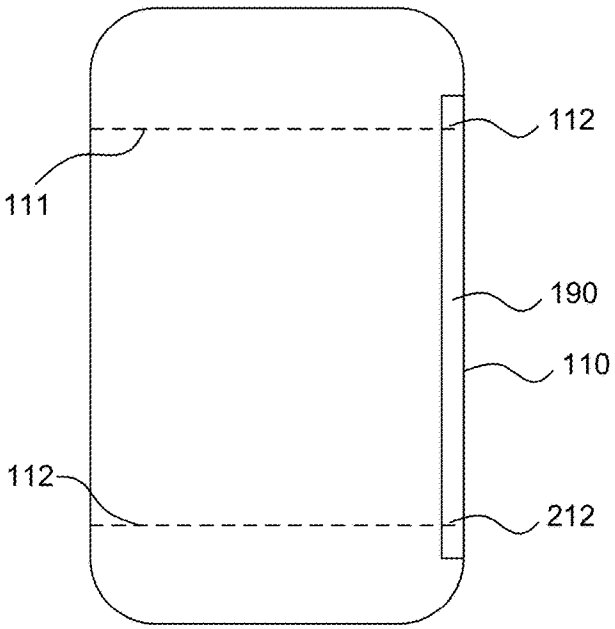
FIG. 6 shows a carbonation tank for a low-pressure carbonation system according to some embodiments.

In some embodiments, high level sensor 112 and low level sensor 212 may comprise capacitance level sensors. In some embodiments, high level sensor 112 and low level sensor 212 may be part of the same sensor, as shown in FIG. 6. For example, carbonation tank 110 may include a capacitance level sensor in the form of a rod 190 configured to detect the level of water in carbonation tank 110. In some embodiments, rod 190 extends from level 211 to level 111. In some embodiments, the portion of rod 190 at level 111 comprises high level sensor 112 and the portion of rod 190 at level 211 comprises low level sensor 212.

Figure 7:
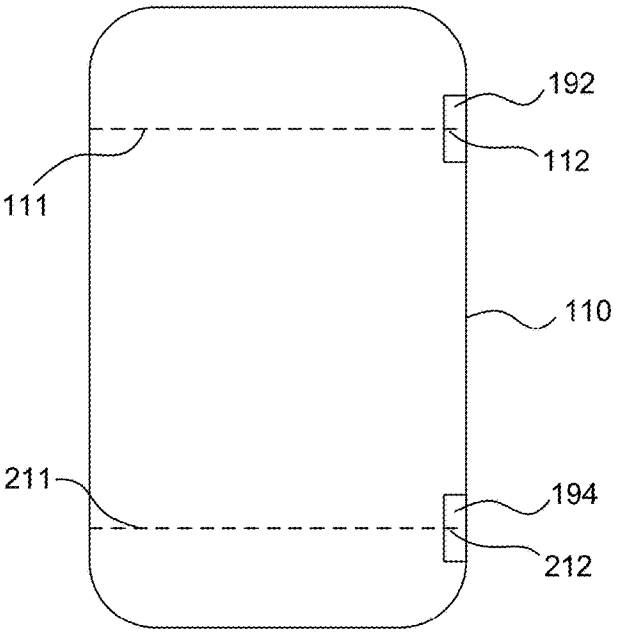
FIG. 7 shows a carbonation tank for a low-pressure carbonation system according to some embodiments.

In some embodiments, high level sensor 112 and low level sensor 212 are distinct sensors. For example, as shown in FIG. 7, carbonation tank 110 may include a capacitance level sensor in the form of a rod 192 disposed at level 111 and another capacitance level sensor in the form of a rod 194 disposed at level 211. Because the capacitance will change when water is present compared to when water is not present, the capacitance level sensor (high level sensor 112 and/or low level sensor 212) will be able to communicate to controller 180 when the water in carbonation tank 110 has reached level 111 or level 112.

Figure 8:
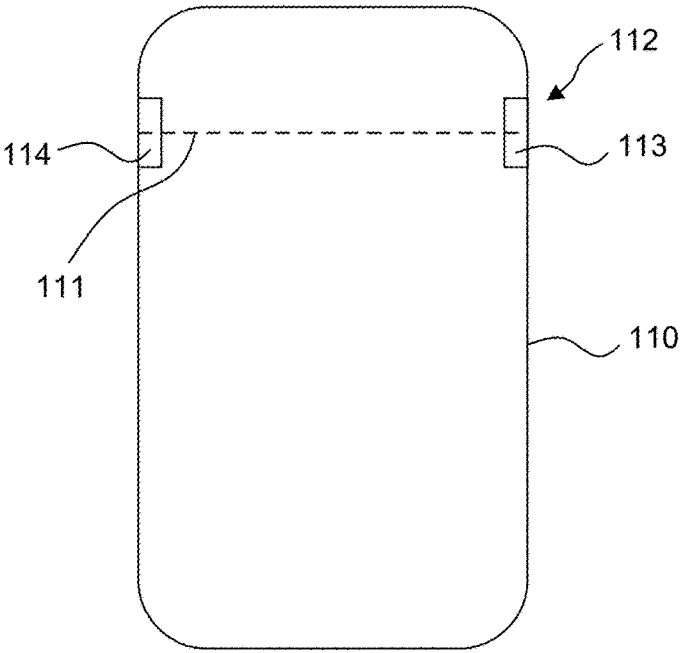
FIG. 8 shows a carbonation tank for a low-pressure carbonation system according to some embodiments.

In some embodiments, high level sensor 112 and/or low level sensor 212 may comprise an optical sensor, such as an infrared sensor. For example, as shown in FIG. 8, high level sensor 112 may include an infrared emitter 113 disposed at level 111 and an infrared receiver 114 disposed at level 111 on an opposite side of carbonation tank 110. Because the behavior of the infrared light when water is present will differ from the behavior of the infrared light when water is not present, infrared receiver 114 will be able to communicate to controller 180 when the water in carbonation tank 110 has reached level 111. Other types of sensors may also be used for high level sensor 112 and or low level sensor 212.

Various aspects of the present invention, or any parts or functions thereof, may be implemented using hardware, software, firmware, tangible computer readable or computer usable storage media having instructions stored thereon, or a combination thereof, and may be implemented in one or more computer systems or other processing systems.

It is to be appreciated that the Detailed Description section, and not the Summary and Abstract sections, is intended to be used to interpret the claims. The Summary and Abstract sections may set forth one or more but not all exemplary embodiments of the present invention(s) as contemplated by the inventor(s), and thus, are not intended to limit the present invention(s) and the appended claims in any way.

The present invention(s) have been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention(s) that others can, by applying knowledge within the skill of the art, readily modify and/or adapt for various applications such specific embodiments, without undue experimentation, without departing from the general concept of the present invention(s). Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention(s) should not be limited by any of the above-described exemplary embodiments, but should be defined only in accordance with the following claims and their equivalents.

What is claimed is:

1. A carbonated drink dispensing system, comprising:

a carbonation tank;

a CO2 cylinder configured to deliver CO2 to the carbonation tank at a pressure of between 50 PSI and 60 PSI;

a low-pressure pump configured to pump water into the carbonation tank;

a level sensor configured to determine when the water in the carbonation tank has reached a pre-determined level; and a controller, wherein the low-pressure pump is configured to stop pumping water when the level sensor determines that the water in the carbonation tank has reached the pre-determined level, wherein the low-pressure pump starts pumping water after a time delay, and wherein the controller is configured to determine the time delay based on a desired concentration of CO2 to water.

2. The carbonated drink dispensing system of claim 1, wherein the low-pressure pump comprises a diaphragm pump.

3. The carbonated drink dispensing system of claim 1, wherein the low-pressure pump comprises a positive displacement pump.

4. The carbonated drink dispensing system of claim 1, wherein the low-pressure pump comprises a self-priming pump.

5. The carbonated drink dispensing system of claim 1, wherein the low-pressure pump operates at a pressure of between 60 PSI and 120 PSI.

6. The carbonated drink dispensing system of claim 1, wherein a highest pressure in the carbonated drink dispensing system is 125 PSI.

7. The carbonated drink dispensing system of claim 1, wherein the controller is configured to stop the low-pressure pump based on the level sensor determining that the water in the carbonation tank has reached the pre-determined level.

8. The carbonated drink dispensing system of claim 1, wherein the predetermined level comprises a high level.

9. The carbonated drink dispensing system of claim 1, wherein the time delay is between 0.5 and 6 seconds.

10. The carbonated drink dispensing system of claim 1, wherein the level sensor is configured to determine when the water is no longer at the pre-determined level.

11. The carbonated drink dispensing system of claim 1, wherein the time delay begins upon dispensing of a carbonated drink from the carbonated drink dispensing system.

12. The carbonated drink dispensing system of claim 1, wherein the level sensor comprises a capacitance level sensor.

13. The carbonated drink dispensing system of claim 1, wherein the level sensor comprises an infrared emitter and an infrared receiver.

14. A carbonated drink dispensing system comprising:

a carbonation tank;

a low-pressure pump configured to pump water into the carbonation tank;

a level sensor configured to determine when the water in the carbonation tank has reached a pre-determined level;

beverage dispensing valves operatively connected to the carbonation tank;

a plurality of gas pumps configured to pump beverage concentrate to the beverage dispensing valves;

a CO2 cylinder; and a pressure regulator configured to deliver CO2 from the CO2 cylinder to the carbonation tank at a first pressure and from the CO2 cylinder to the plurality of gas pumps at the first pressure, wherein the low-pressure pump is configured to stop pumping water when the level sensor determines that the water in the carbonation tank has reached the pre-determined level, and wherein the low-pressure pump starts pumping water after a time delay that is based on a desired concentration of CO2 to water.

15. The carbonated drink dispensing system of claim 14, further comprising tubing between the pressure regulator and the carbonation tank, wherein the tubing comprises polyethylene.

16. The carbonated drink dispensing system of claim 15, further comprising quick connectors configured to connect sections of the tubing, wherein the quick connectors comprise plastic.

17. The carbonated drink dispensing system of claim 14, wherein the first pressure is less than 60 PSI.

18. The carbonated drink dispensing system of claim 14, wherein the first pressure is 55 PSI.

* * * * *